US009526957B2

(12) United States Patent
Lin

(10) Patent No.: US 9,526,957 B2
(45) Date of Patent: Dec. 27, 2016

(54) GOLF CLUB SHAFT PROTECTOR

(71) Applicant: Zhuhai Shichang Metals Ltd., Zhuhai (CN)

(72) Inventor: Wen-Sheng Lin, Kaohsiung (TW)

(73) Assignee: Zhuhai Shichang Metals Ltd. (CN)

( * ) Notice: Subject to any disclaimer, the term of this patent is extended or adjusted under 35 U.S.C. 154(b) by 46 days.

(21) Appl. No.: 14/584,884

(22) Filed: Dec. 29, 2014

(65) Prior Publication Data

US 2016/0184674 A1 Jun. 30, 2016

(51) Int. Cl.
*A63B 55/00* (2015.01)

(52) U.S. Cl.
CPC ..... *A63B 55/00* (2013.01)

(58) Field of Classification Search
CPC ..... A63B 55/02; A63B 60/62; A63B 60/64
USPC ..... 206/315.2; 150/60
See application file for complete search history.

(56) References Cited

U.S. PATENT DOCUMENTS

| | | | | |
|---|---|---|---|---|
| 1,951,492 | A * | 3/1934 | Schneider | A63B 55/10 206/315.2 |
| 2,595,987 | A | 5/1952 | Shears | |
| 4,497,404 | A | 2/1985 | Lowrance | |
| 4,746,014 | A | 5/1988 | Very | |
| 4,938,349 | A | 7/1990 | Burns | |
| 5,050,884 | A | 9/1991 | Flory | |
| 5,088,600 | A | 2/1992 | Kopp, Jr. | |
| 5,275,278 | A | 1/1994 | Henry et al. | |
| D348,092 | S | 6/1994 | Misko, Jr. | |
| 5,573,241 | A | 11/1996 | Anderson | |
| 5,720,388 | A | 2/1998 | King et al. | |
| 6,216,864 | B1 | 4/2001 | Chang | |
| 6,343,692 | B1 * | 2/2002 | Park | A63B 55/00 206/315.2 |
| 6,929,124 | B2 | 8/2005 | Kawasaki | |
| 7,284,659 | B2 * | 10/2007 | Sugarek | A63B 55/10 206/315.2 |
| 7,814,950 | B2 * | 10/2010 | Martin | A63B 57/00 150/155 |
| 7,886,787 | B1 | 2/2011 | Wilson | |

(Continued)

FOREIGN PATENT DOCUMENTS

| | | | |
|---|---|---|---|
| GB | 980829 | * | 6/1965 |
| WO | 0102064 A1 | | 1/2001 |

*Primary Examiner* — Sue A Weaver
(74) *Attorney, Agent, or Firm* — Luedeka Neely Group, P.C.

(57) ABSTRACT

The specification provides a golf club shaft protector which includes a first tube member, a second tube member, a first end cap, and a second end cap. Each of the first and second tube members has a generally semi-oval cross-section and the first and second tube members are interlocked with one another along opposed elongate edges to form a hollow tube. This hollow tube has first end and a second end and an inner diameter sized for receiving and retaining a golf club shaft. The first end cap includes a cylindrical side portion and a closed top portion and fits over the first end of the hollow tube. The second end cap also includes a cylindrical side portion and a top portion and fits over the first end of the hollow tube. The top portion of the second end cap includes an opening for inserting and removing a golf club shaft and a plurality of flexible teeth disposed around a perimeter of the opening.

8 Claims, 6 Drawing Sheets

(56) References Cited

U.S. PATENT DOCUMENTS

| | | | | |
|---|---|---|---|---|
| 8,506,414 | B2 * | 8/2013 | Snyder | A63B 53/00<br>473/226 |
| 2003/0213711 | A1 * | 11/2003 | Kang | A63B 60/62<br>206/315.2 |
| 2005/0049071 | A1 * | 3/2005 | Chuang | A63B 53/14<br>473/300 |
| 2010/0292022 | A1 * | 11/2010 | Stites | A63B 53/10<br>473/318 |
| 2012/0090746 | A1 * | 4/2012 | Barnett | A63B 57/00<br>150/160 |
| 2012/0190475 | A1 * | 7/2012 | Kfuri | A63B 53/02<br>473/318 |

* cited by examiner

GOLF CLUB SHAFT PROTECTOR

FIELD

The present disclosure relates to golf equipment. More particularly, the present disclosure relates to a protective device for a golf club shaft.

BACKGROUND

Golf club shafts were originally made from wood and eventually steel. More modern golf clubs designs, however, often use club shafts made from materials such as graphite or titanium. Such materials are particularly common in drivers. The use of such materials provides performance advantages for the golfer, in that the club shaft is more flexible and/or lighter in weight. Both of these characteristics will typically lead to improved club head speed.

Golf club shafts made from graphite or titanium are significantly more expensive to make that club shafts made from wood or steel. Moreover, such club shafts are more prone to being broken, bent, or otherwise damaged. This is especially true when the golf clubs are being transported from one location to another by car or by airplane.

What is needed, therefore, is a simple and lightweight golf club shaft protection device for protecting expensive and relatively fragile club shafts when the golf clubs are being transported.

SUMMARY

The above and other needs are met by a golf club shaft protector according to the current disclosure. According to one embodiment, the golf club shaft protector includes a first tube member, a second tube member, a first end cap, and a second end cap. Each of the first and second tube members has a generally semi-oval cross-section and the first and second tube members are interlocked with one another along opposed elongate edges to form a hollow tube. This hollow tube has first end and a second end and an inner diameter sized for receiving and retaining a golf club shaft. The first end cap includes a cylindrical side portion and a closed top portion and fits over the first end of the hollow tube. The second end cap also includes a cylindrical side portion and a top portion and fits over the first end of the hollow tube. The top portion of the second end cap includes an opening for inserting and removing a golf club shaft and a plurality of flexible teeth disposed around a perimeter of the opening.

In certain embodiments of the present disclosure, the first and second tube members are each preferably made from a rigid material selected from the group consisting of polymeric materials, metals, and metal alloys. More preferably, the first and second tube members are each made from aluminum or an aluminum alloy.

In certain embodiments of the present disclosure, the first end cap is preferably made from a plastic material and the second end cap is preferably made from a rubber material.

In certain embodiments of the present disclosure, the first tube member preferably includes a first elongate edge having at least one rib projection and a second elongate edge having at least one groove. In addition, the second tube member includes a first elongate edge having at least one groove and a second elongate edge having at least one rib projection. The first tube member rib projection interlocks with the second tube member groove and the second tube member rib projection interlocks with the first tube member groove.

In certain embodiments of the present disclosure, the inner diameter of the hollow tube is preferably from about 25 to about 45 mm. Moreover, in certain embodiments of the present disclosure, the length of the hollow tube is from about 1.0 to about 1.25 meters.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
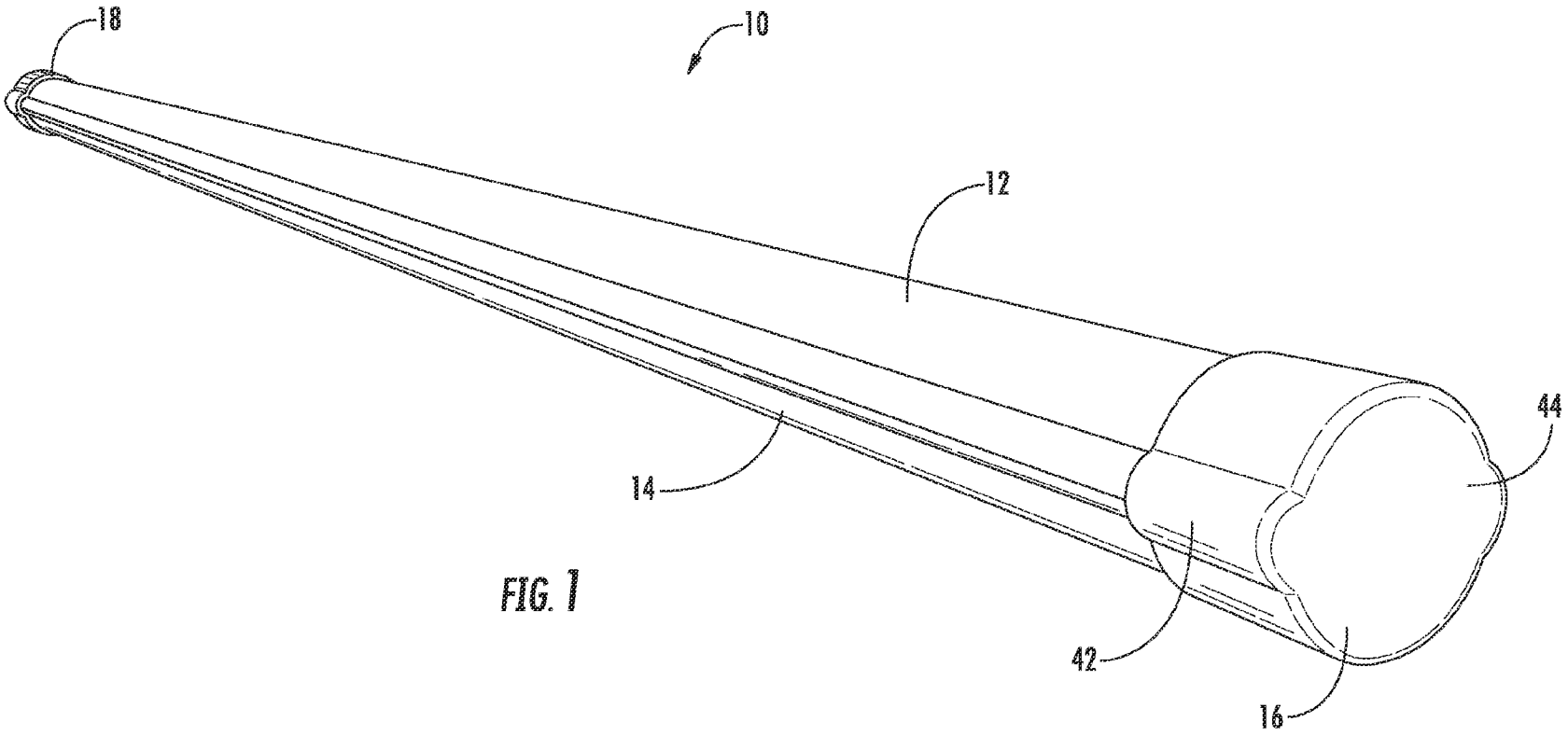
FIGS. 1 &2 are side perspective views of a golf club shaft protector according to one embodiment of the present disclosure.
Figure 2:
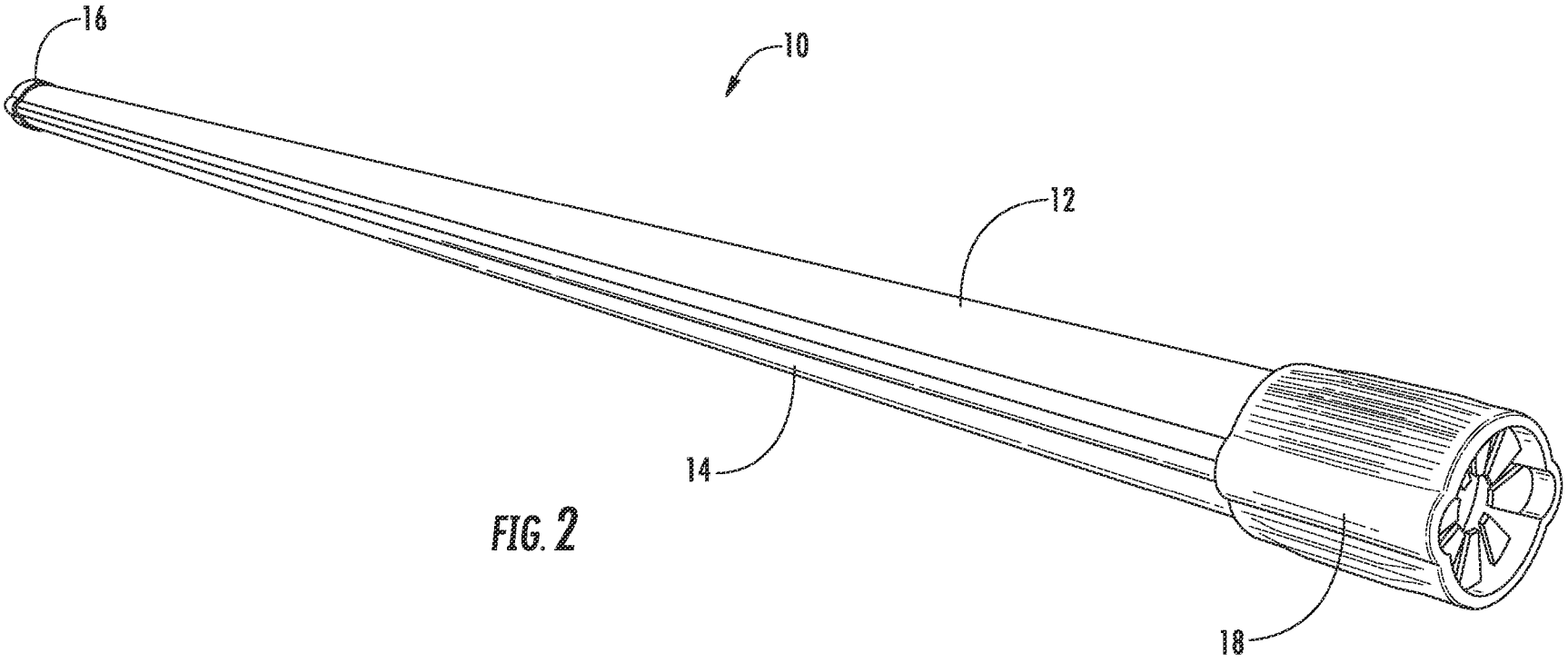

According to the present disclosure, a golf club shaft protector 10 is provided. With reference to FIGS. 1 & 2, in one embodiment, the golf club shaft protector 10 includes a first tube member 12, a second tube member 14, a first end cap 16, and a second end cap 18.

Figure 3:
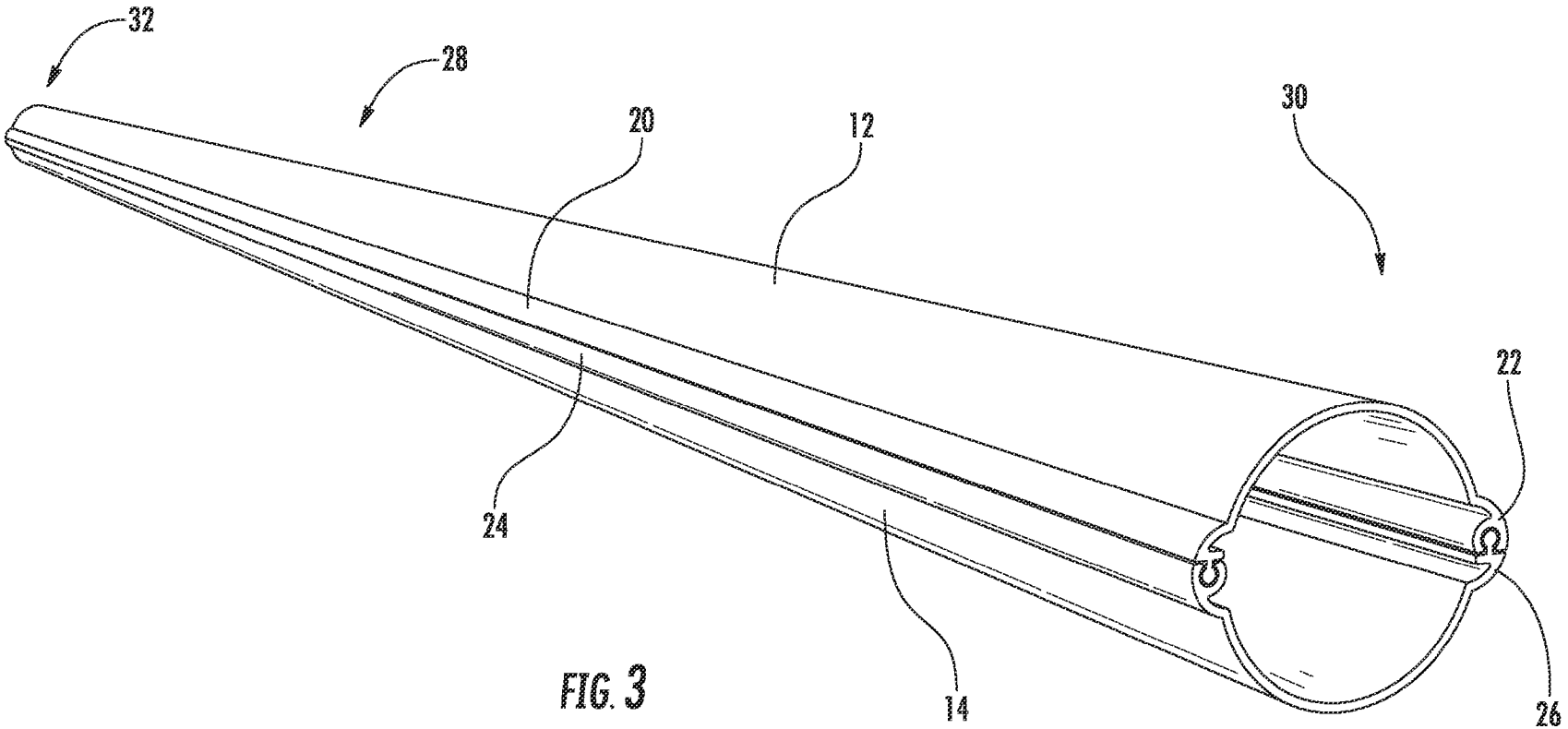
FIG. 3 is a side perspective view of a hollow tube for a golf club shaft protector according to one embodiment of the present disclosure.
Figure 4:
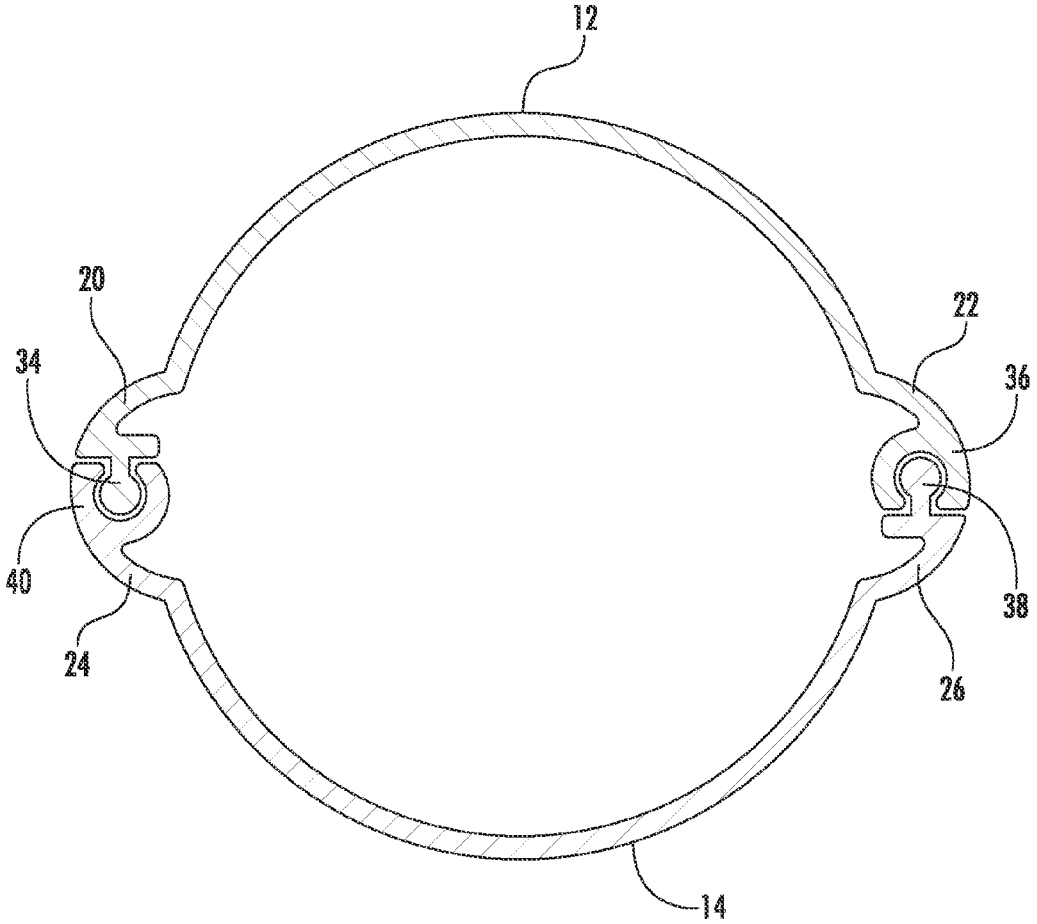
FIG. 4 is an end view of a hollow tube for a golf club shaft protector according to one embodiment of the present disclosure.

As seen in FIGS. 3 & 4, each of the first and second tube members 12, 14 is an elongate member having a generally semi-oval cross-section. More preferably, each of the first and second tube members 12, 14 has a generally semi-circular cross-section Thus, the first and second tube members 12, 14 may be joined together another along opposed elongate edges 20, 22, 24, 26 to form a hollow tube 28 into which a golf club shaft may be inserted for protection.

This hollow tube 28 has first end 30 and a second end 32 and an inner diameter sized for receiving and retaining a golf club shaft. In certain embodiments of the present disclosure, the inner diameter of the hollow tube 28 is preferably from about 25 to about 45 mm. Moreover, in certain embodiments of the present disclosure, the length of the hollow tube 28 is preferably from about 1.0 to about 1.25 meters.

In certain embodiments of the present disclosure, the first and second tube members 12, 14 are each preferably made from a rigid material selected from the group consisting of polymeric materials, metals, and metal alloys. More preferably, the first and second tube members 12, 14 are each made from a metal or metal alloy, such as steel, aluminum, or an aluminum alloy.

As noted above, the first and second tube members 12, 14 are joined together another along opposed elongate edges to form the hollow tube 28. For instance, in certain embodiments, the first tube member 12 may include one or more rib projections 34 along a first edge 20 and one or more grooves 36 along a second edge 22. As best seen in FIG. 4, the second tube member 14 may then include one or more grooves 40 along a first edge 24 and one or more rib projections 38 along a second edge 26. The one or more rib projections 34 of the first tube member 12 may then be interlocked with the one or more grooves 40 of the second tube member 14, and the one or more rib projections 38 of the second tube member 14 may be interlocked with the one or more grooves 36 of the first tube member 12. For instance, the corresponding ribs and grooves may be snapped together to form the hollow tube, or the ribs and grooves may be slidingly engaged with one another.

The hollow tube 28 has a first end 30 and a second end 32, both of which are fitted with end caps 16, 18.

The first end cap 16, which is fitted over the first end 30 of the hollow tube 28, includes a cylindrical side portion 42 and a closed top portion 44, as shown in FIG. 1. The first end cap 16 is preferably made from a plastic or polymeric material.

Figure 5:
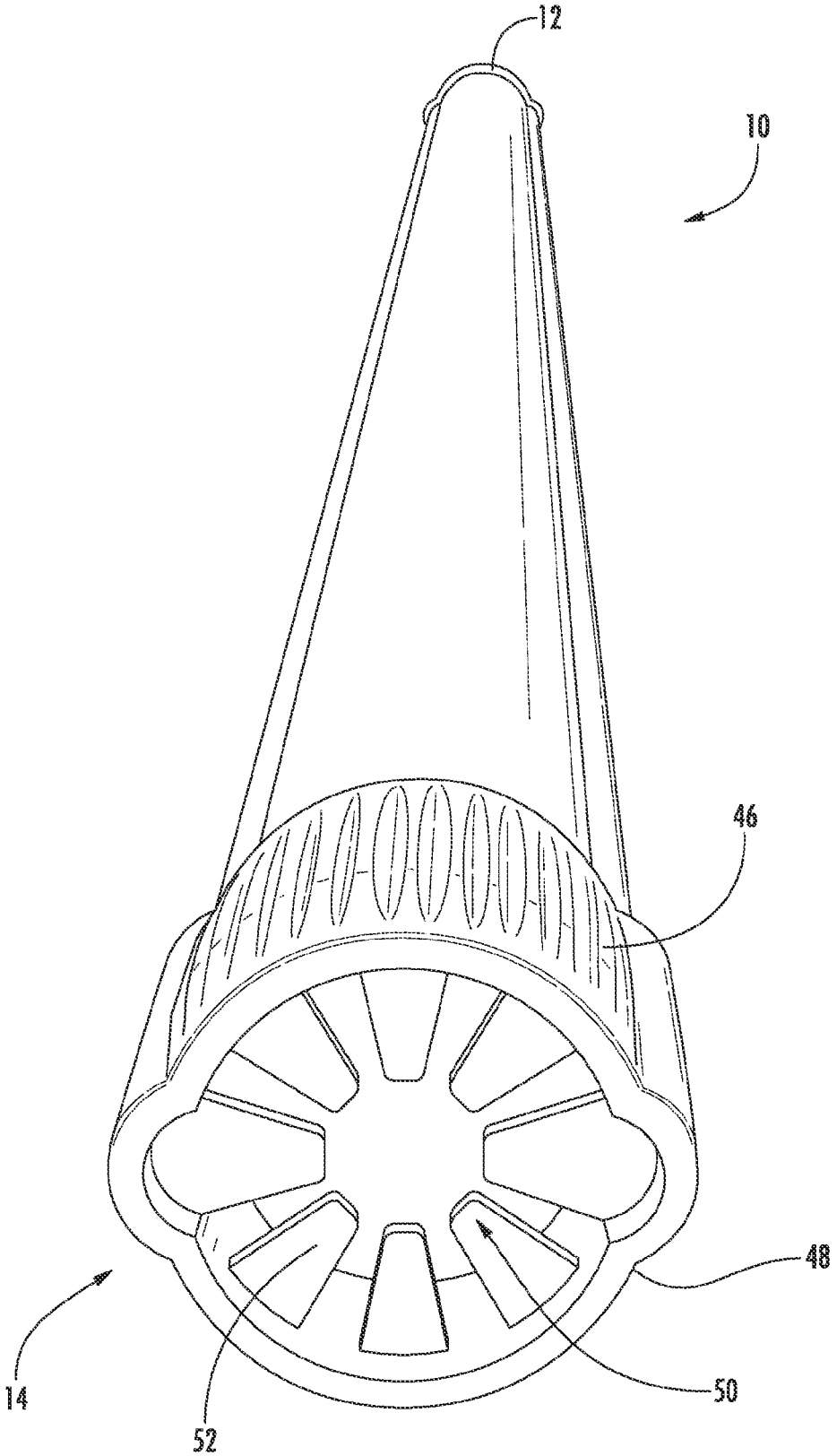
FIG. 5 is a end perspective view of a golf club shaft protector according to one embodiment of the present disclosure.

As best seen in FIGS. 2 & 5, the second end cap 18 also includes a cylindrical side portion 46 and a top portion 48 and fits over the second end 32 of the hollow tube 28. If desired, a plurality of ribs may be formed on the cylindrical side portion 46. The second end cap 18 is preferably made from a resilient rubber material.

The top portion 48 of the second end cap 18 includes an opening 50 for inserting and removing a golf club shaft. In addition, the top portion 48 of the second end cap 18 also includes a plurality of flexible teeth-like projections 52 disposed around a perimeter of the opening 50. These teeth 52 allow the size of the opening 50 to vary somewhat to accommodate the variation in club shaft diameter from the grip of the golf club down to the hosel of the club head.

Figure 6:
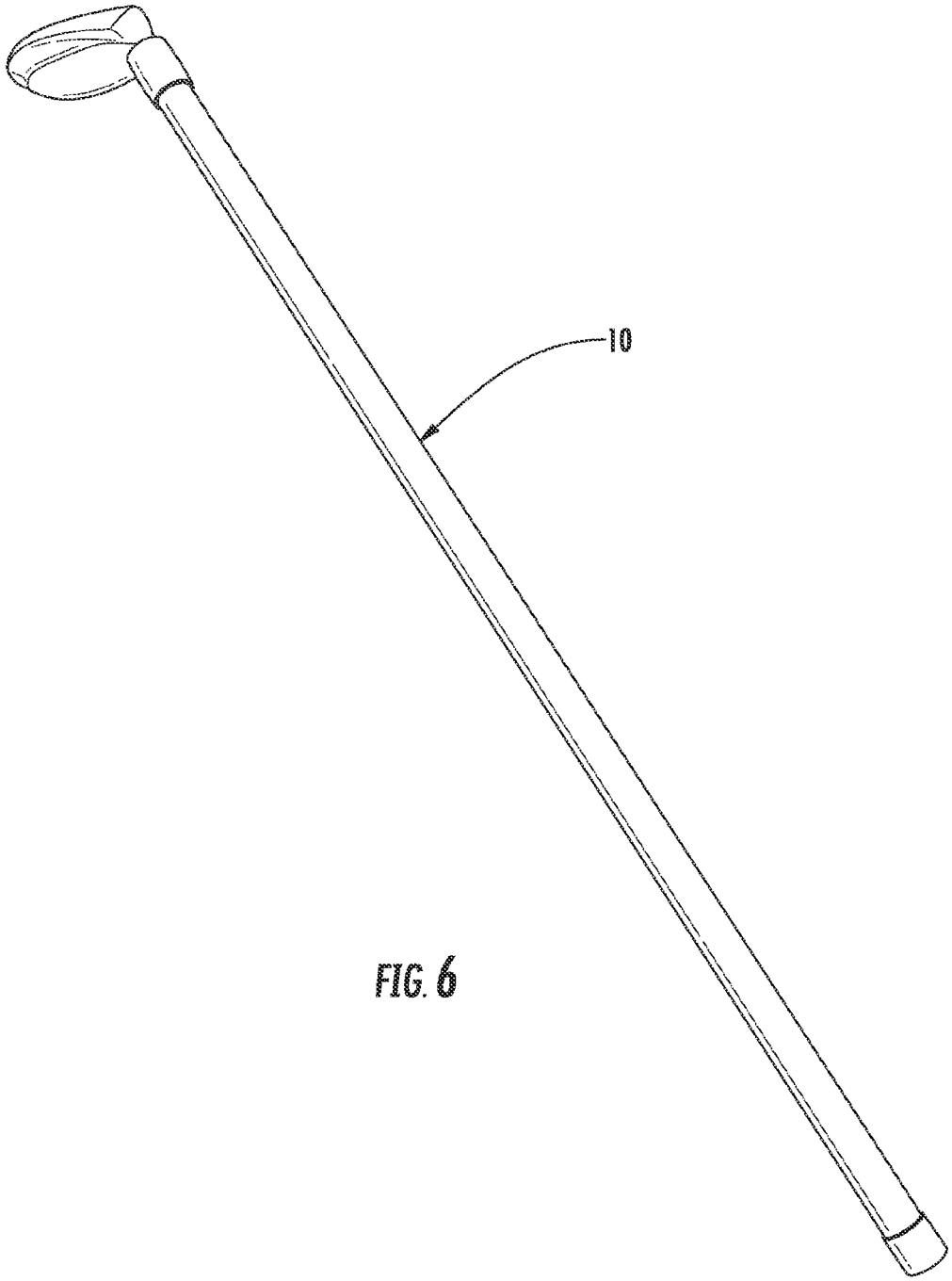
FIG. 6 is a side perspective view of a golf club shaft protector according to one embodiment of the present disclosure, fitted over a golf club.

The golf club shaft protector 10 is placed over the club shaft by first inserting the grip end of the club shaft through the second end cap opening 50 and then sliding the club shaft protector 10 down the length of the club shaft. The club shaft protector 10 preferably covers the entire club shaft length from the grip to the club head and hosel, as shown in FIG. 6.

Advantageously, the golf club shaft protector according 10 to the present disclosure provides a simple and lightweight device for protecting expensive and often fragile club shafts while the golf clubs are being transported. Even if the hollow tube 28 of the protector is impacted and slightly dented, the club shaft within may still be protected from damage.

A further advantage may be found in the two-part design of the hollow tube 28 according to the present design. Should the tube 28 become damaged and dented due to rough handling, the inner diameter of the tube may become reduced by indentation. In some instances, this reduction in diameter may be sufficient so as to prevent the club shaft from sliding out of protector 10 via the opening 50 in the second end cap 18. Should this occur, the golf club may still be removed from the protector of the present disclosure sliding off the two end caps 16, 18 and separating the first and second tube members 12, 14 which make up the tube from one another.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A golf club shaft protector comprising:

a first tube member having:

a first elongate edge comprising a rib projection; and a second elongate edge comprising a groove;

a second tube member having:

a third elongate edge comprising a groove; and a fourth elongate edge comprising a rib projection, wherein the rib projection of the first elongate edge of the first tube member interlocks with the groove of the third elongate edge of the second tube member, and the rib projection of the fourth elongate edge of the second tube member interlocks with the groove of the second elongate edge of the first tube member to form a hollow tube having a first end and a second end and an inner diameter sized for receiving and retaining a golf club shaft;

a first end cap fitted over the first end of the hollow tube, the first end cap comprising a tubular side portion and a closed bottom portion; and a second end cap fitted over the second end of the hollow tube, the second end cap comprising a tubular side portion and a top portion, the top portion having an opening for inserting and removing a golf club shaft and a plurality of flexible teeth disposed around a perimeter of the opening.

2. The golf club shaft protector of claim 1, wherein the first and second tube members each comprise a rigid material selected from the group consisting of polymeric materials, metals, and metal alloys.

3. The golf club shaft protector of claim 1, wherein the first and second tube members each comprise aluminum or an aluminum alloy.

4. The golf club shaft protector of claim 1, wherein the first end cap comprises a plastic material and the second end cap comprises a rubber material.

5. The golf club shaft protector of claim 1, wherein the inner diameter of the hollow tube is from about 25 to about 45 mm.

6. The golf club shaft protector of claim 1, wherein the length of the hollow tube is from about 1.0 to about 1.25 meters.

7. The golf club shaft protector of claim 1 wherein the first tube member may be disengaged from the second tube member by longitudinally sliding the rib projection of the first elongate edge of the first tube member within the groove of the third elongate edge of the second tube member, and the rib projection of the fourth elongate edge of the second tube member within the groove of the second elongate edge of the first tube member.

8. A golf club shaft protector comprising:

a first tube member and a second tube member, each of the first and second tube members having a generally semi-oval cross-section and being interlocked with one another to form a hollow tube having a first end and a second end and an inner diameter sized for receiving and retaining a golf club shaft;

the first tube member comprising a first elongate edge having at least one rib projection and a second elongate edge having at least one groove;

the second tube member comprising a third elongate edge having at least one groove and a fourth elongate edge having at least one rib projection, wherein the rib projection of the first elongate edge interlocks with the at least one groove of the third elongate edge and the rib projection of the fourth elongate edge interlocks with the at least one groove of the second elongate edge;

a first end cap, fitted over the first end of the hollow tube, comprising a cylindrical side portion and a closed bottom portion; and a second end cap, fitted over the second end of the hollow tube, comprising a cylindrical side portion and a top portion, the top portion having an opening for inserting and removing a golf club shaft.

* * * * *